United States Patent [19]

Menown

[11] 4,293,800

[45] Oct. 6, 1981

[54] DOUBLE-ENDED THYRATRON HAVING AT LEAST THREE GRIDS

[75] Inventor: Hugh Menown, Writtle, England

[73] Assignee: English Electric Valve Company, Chelmsford, England

[21] Appl. No.: 46,902

[22] Filed: Jun. 3, 1979

Related U.S. Application Data

[63] Continuation of Ser. No. 909,259, May 24, 1978, abandoned, and a continuation of Ser. No. 780,486, Mar. 23, 1977, abandoned.

[30] Foreign Application Priority Data

Mar. 27, 1976 [GB] United Kingdom ..... 12415/76

[51] Int. Cl.[3] ..... H01J 17/12

[52] U.S. Cl. ..... 315/350; 313/195; 313/197; 315/336; 315/337

[58] Field of Search ..... 313/188, 195, 197, 198, 313/300; 315/335-337, 350

[56] References Cited

U.S. PATENT DOCUMENTS

| | | | |
|---|---|---|---|
| 1,897,482 | 2/1933 | Kenty | 313/198 X |
| 2,504,231 | 4/1950 | Smith | 313/195 X |
| 2,506,740 | 5/1950 | Reitherman | 315/336 X |
| 3,898,518 | 8/1975 | Menown et al. | 313/195 X |
| 4,081,719 | 3/1978 | Molyneux-Berry | 315/350 |

OTHER PUBLICATIONS

"A Multigap, Double-Ended Hydrogen Thyratron", H. Menown & B. P. Newton, Sep. 1973, Eleventh Modulator Symposium, 8 pages.

*Primary Examiner*—Eugene R. La Roche
*Attorney, Agent, or Firm*—Diller, Ramik & Wight

[57] ABSTRACT

A double-ended thyratron is provided which has, at each end, three grids between a cathode and adjacent voltage withstanding gap, the final grid being connected to its associated cathode. In a circuit arrangement including the thyratron, the first grid adjacent a cathode at each end is connected to a source of current bias and the intermediate grids at each end are connected to mutually isolated trigger signal sources.

9 Claims, 4 Drawing Figures

DOUBLE-ENDED THYRATRON HAVING AT LEAST THREE GRIDS

This is a continuation of application Ser. No. 909,259 filed May 24, 1978.

This invention relates to thyratrons, and in particular to double-ended thyratrons, and circuit arrangements incorporating the same.

Double-ended thyratrons form the subject of U.K. Pat. No. 1,334,527 and, are described in a paper entitled "A Multigap Double-Ended Hydrogen Thyratron" presented by H. Menown and B. P. Newton at the Eleventh Modulator Symposium, September, 1973. A typical double-ended hydrogen thyratron is illustrated in FIG. 1 of the accompanying drawings.

BRIEF DESCRIPTION OF THE DRAWING

Referring to FIG. 1, the thyratron has a ceramic or glass envelope 1, within which is a gaseous filling of hydrogen or its isotope, deuterium. At one end of the tube is a cathode 2, a first grid 3 and a second grid 4. At the other end of the tube, is a similar structure consisting of a cathode 5, a first grid 6 and a second grid 7. Between second grids 4 and 7 is a high voltage withstanding gap 8.

As is noted hereinafter, a thyratron constructed according to this invention may incorporate one or more voltage withstanding gaps, in accord with known practice. FIG. 3 illustrates such structure in accord with the aforesaid paper presented by H. Menown and B. P. Newton. As shown, the high voltage withstanding gap structure, located between the grids 4 and 7 within the tube envelope, comprises a plurality of intermediate electrodes G1, G2, G3 and G4 which are externally connected between the lines L1 and L2 by means of a voltage dividing chain of resistors R1, R2 and R3. As is also conventional, the individual electrodes may be connected to their voltage dividing points by means of further resistors R4, R5, R6 and R7.

Figure 1:
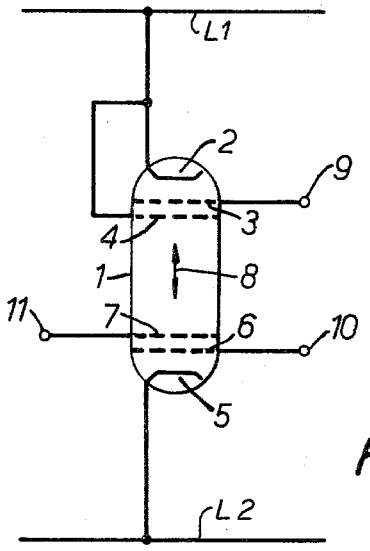
FIG. 1. (PRIOR ART)
FIG. 1 is a simplified illustration of a typical prior art thyratron.

Typically the thyratron is arranged with one of its cathodes, in this case cathode 5, functioning as a cathode whilst the other cathode 2 is connected to the second grid 4 at that end of the tube. The grid 4 and cathode 2 together then act as an anode. Grids 3 and 6 are connected to d.c. current bias sources represented by the terminals 9 and 10 respectively. The second grid 7, at the end of the tube which is arranged to act as the cathode end, is connected to a source of trigger pulses represented by the terminal 11.

In the operation of the thyratron, arranged as represented in FIG. 1, the currents applied to terminals 9 and 10 cause electrons to flow between cathode 2 and electrode 3 on the one hand and cathode 5 and electrode 6 on the other hand. This causes the gas filling to be ionised in the vicinity of both of the first grids 3 and 6, which maintains each end of the thyratron in a state of readiness to conduct. In this situation, if a trigger pulse is applied via terminal 11 to the second grid 7 at the end of the thyratron arranged to act as a cathode end, the thyratron conducts in a manner common to all thyratrons, whether double-ended or not. If no reversal of current occurs the performance is, in fact, similar to that of a normal single-ended thyratron. By virtue of the second grid 3 being connected to its cathode 2, the second grid 3 is "seen" mainly as the anode electrode of the thyratron.

If the direction of current flow should then reverse, the presence of plasma (ionised gas) both within the envelope of the thyratron, and particularly around the grids 3 and 4, ensures that electrons can flow from cathode 2, which was previously acting in part as an anode, through the openings in grids 3 and 4 and hence enable the thyratron to continue to conduct in the normal thyratron manner, but, in a reverse direction.

Thus the double-ended thyratron described above can initially withstand voltage in either direction, but, once triggered as described, it can subsequently conduct in either direction so long as sufficient current flows to maintain the state of ionisation within the thyratron envelope.

The present invention seeks to provide an improved double-ended thyratron and circuit arrangement incorporating the same.

According to this invention, a double-ended thyratron is provided having, at each end, at least three grids between a cathode and a voltage withstanding gap.

In a preferred example of a thyratron in accordance with the present invention, at each end the final grid, adjacent the voltage withstanding gap, is electrically connected to its associated cathode. A final grid and its associated cathode may be electrically connected by an internal or an external electrical connection.

Said thyratron may comprise a single voltage withstanding gap or, as known per se, two or more voltage withstanding gaps.

In a preferred circuit arrangement including a thyratron as described above, at each end of said thyratron the final grid, adjacent said voltage withstanding gap, is electrically connected to its cathode, the first grid, adjacent the cathode, is connected to a source of current bias and a grid intermediate said first and said final grids is connected to a source of trigger signals, the source of trigger signals to which one of said intermediate grids is connected being suitably insulated from the source of trigger signals to which the other of said intermediate grids is connected where necessary to withstand the voltage appearing across the voltage withstanding gap or gaps in operation.

Preferably both ends of said thyratron are symmetrical and in a preferred example three grids are provided between the cathode and voltage withstanding gap at each end of said thyratron.

At each end of said thyratron said final grid may be connected to its associated cathode via impedance.

Where said intermediate grids are arranged to be triggered simultaneously, said thyratron will conduct in either direction when so triggered. If said intermediate grids are arranged to be triggered independently said thyratron will initially conduct only in a direction determined by which of the intermediate grids are triggered.

The invention is further described with reference to FIG. 2 of the accompanying drawings which schematically illustrates one example of a thyratron and thyratron arrangement in accordance with the present invention.

Figure 2:
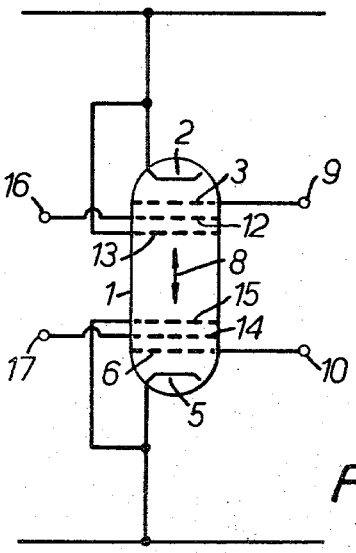
FIG. 2 is a view, similar to FIG. 1, but showing the arrangement according to this invention.
Figure 3:
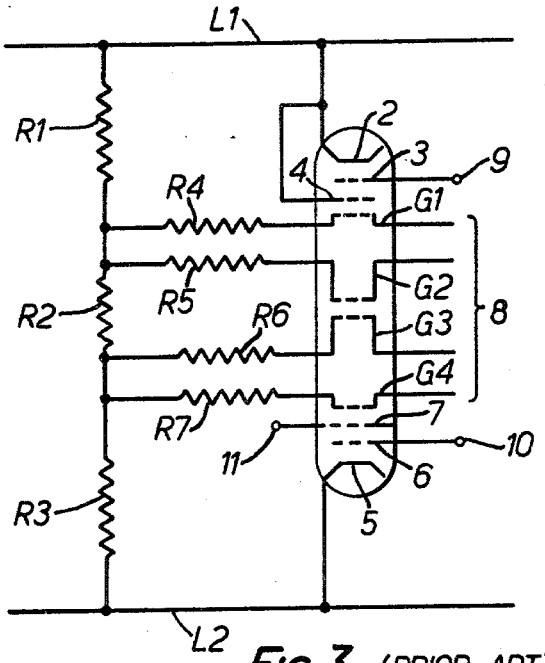
FIG. 3. (PRIOR ART)
FIG. 3 is a view similar to FIG. 1 but showing a prior art arrangement for providing the voltage withstanding gap 8 of FIGS. 1 and 2.

In FIG. 2, like references are used for like parts in FIG. 1.

Comparing FIG. 1 with FIG. 2, it will be seen that, so far as the thyratron itself is concerned, the principle difference resides in the provision of three grids between the cathode and voltage withstanding gap at each end of the tube.

Between cathode 2 and voltage withstanding gap 8 are, in order, a first grid 3, an intermediary grid 12 and (adjacent the voltage withstanding gap 8) a final grid 13.

Between cathode 5 and voltage withstanding gap 8 are, in order a first grid 6, an intermediary grid 14 and (adjacent the voltage withstanding gap 8) a final grid 15.

As before, at each end of the tube the first grids 3 and 6 adjacent the cathodes 2 and 5 are connected to sources of current bias 9 and 10. The intermediary grids 12 and 14 are arranged, in this example, to be triggered together from respective sources of trigger pulses 16 and 17. Trigger pulse sources 16 and 17 are suitably mutually insulated as necessary to withstand the voltage across the voltage withstanding gap in operation, by the use of pulse transformers, optical couplers or the like (not shown).

Final grids 13 and 15 are connected to their respective associated cathodes 2 and 5.

In operation, the first grids 3 and 6 act as before to pre-ionise the gas filling in the vicinity of their respective cathodes 2 and 5. The nature of the bias applied to terminals 9 and 10 may be a steady direct current or a positive acting pulse or a combination of both. When both intermediary grids 12 and 14 are triggered simultaneously the thyratron will conduct in either direction. The connection, at both ends, of the final grids 13 and 15 to their respective cathodes 2 and 5 does not interfere with the triggering process nor with the ability of the thyratron to carry reverse current. However, whichever direction the thyratron is conducting one or other of the final grids 13 and 15 can act mainly as an anode so reducing the risk of damage to the thermionic cathode at that end. Furthermore, since both final grids 13 and 15 are now connected to their respective cathodes 2 and 5, both act to screen the remaining grids from changes in potential occurring across the thyratron. This last mentioned feature tends to reduce the risk of premature triggering of the thyratron due to external potential changes and tends to reduce the risk of damage to circuits connected to terminals 16 and 17 supplying triggering signals.

Whilst with the arrangement of FIG. 2 intermediary grids 12 and 14 may be arranged to be triggered simultaneously as described, they may equally be arranged to be triggered independently so as to provide initial conduction only in one direction in dependence upon which of the intermediary grids 12 or 14 is triggered.

Figure 4:
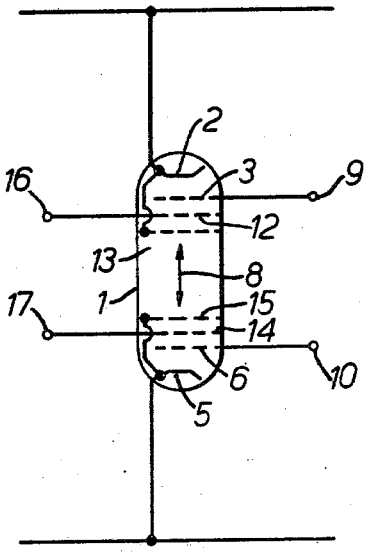
FIG. 4 is a view similar to FIG. 2 in which certain electrodes are internally connected.

FIG. 4 shows essentially the structure of FIG. 2 except that the electrical connections between cathodes 2 and 5 and their respective final grids 13 and 15 are internal.

I claim:

1. A double-ended thyratron having, at each end, a set of at least three grids between a cathode and means for providing at least one voltage withstanding gap.

2. A thyratron as claimed in claim 1 and wherein at each end the final grid, adjacent the voltage withstanding gap, is electrically connected to its associated cathode.

3. A thyratron as claimed in claim 2 and wherein a final grid and its associated cathode are electrically connected by an internal electrical connection.

4. A thyratron as claimed in claim 2 and wherein a final grid and its associated cathode are electrically connected by an external electrical connection.

5. A thyratron as claimed in claim 1 wherein said means provides a single voltage withstanding gap.

6. A thyratron as claimed in claim 1 wherein said means provides two or more voltage withstanding gaps.

7. A thyratron as claimed in claim 1 and wherein both ends of said thyratron are symmetrical.

8. A thyratron as claimed in claim 1 and wherein three grids are provided between the cathode and voltage withstanding gap means at each end of said thyratron.

9. A double-ended thyratron comprising, in combination:

an envelope having a pair of cathodes disposed in spaced apart relation therewithin; and a first set of at least three grids adjacent one of said cathodes and a second set of at least three grids adjacent the other of said cathodes, the grids of each set being disposed in serially spaced fashion with the final grids of the two sets being disposed in remotely spaced, opposing relation and there being means providing at least one voltage withstanding gap between said first and second sets of grids, each set being exclusive of said means and comprising a first grid disposed closest to the associated cathode and adapted to receive an electrical potential independently of the remainder of the grids of that set whereby independently to receive a current bias, an intermediary grid between such first grid and the final grid of that set and adapted to receive an electrical potential independently of the remainder of the grids of that set whereby independently to receive a trigger pulse, and said final grid which is electrically connected to its associated cathode.

* * * * *